United States Patent [19]

Krause

[11] Patent Number: 4,799,419

[45] Date of Patent: Jan. 24, 1989

[54] MULTI-CYLINDER HYDRAULIC PISTON DEVICE, A CYLINDER THEREFOR, AND ITS METHOD OF MAKING

[75] Inventor: Bernd Krause, Mainaschaff, Fed. Rep. of Germany

[73] Assignee: Linde Aktiengesellschaft, Mainaschaff, Fed. Rep. of Germany

[21] Appl. No.: 549,974

[22] Filed: Nov. 9, 1983

Related U.S. Application Data

[63] Continuation of Ser. No. 294,514, Aug. 20, 1981, abandoned, which is a continuation of Ser. No. 22,839, Mar. 22, 1979, abandoned.

[30] Foreign Application Priority Data

Mar. 22, 1978 [DE] Fed. Rep. of Germany ..... 2812417

[51] Int. Cl.[4] ..... F01B 3/00

[52] U.S. Cl. ..... 91/499; 92/57; 92/169; 148/16.6; 204/58

[58] Field of Search ..... 91/472, 499; 92/12.2, 92/56, 57, 146, 147, 169; 148/6.35, 16.6; 204/26, 385, 56, 58; 308/237 R, 241, DIG. 5

[56] References Cited

U.S. PATENT DOCUMENTS

| | | | |
|---|---|---|---|
| 1,600,961 | 9/1926 | Payne | 308/241 |
| 2,048,578 | 2/1934 | Van Der Horst | 204/26 |
| 2,760,925 | 3/1952 | Bryant | 308/241 |
| 2,933,386 | 4/1960 | Pessel | 148/16.6 |
| 3,033,183 | 5/1962 | Erickson | 92/169 |
| 3,080,854 | 3/1963 | Wiggermann | 91/499 |
| 3,280,758 | 10/1966 | Leeming et al. | 92/169 |
| 3,709,107 | 1/1973 | Alger, Jr. et al. | 91/499 |
| 3,793,195 | 2/1974 | Betts | 308/241 |
| 3,901,740 | 8/1975 | Anderson et al. | 148/16.6 |

FOREIGN PATENT DOCUMENTS

| | | | |
|---|---|---|---|
| 1963769 | 6/1971 | Fed. Rep. of Germany . | |
| 2431254 | 1/1976 | Fed. Rep. of Germany . | |
| 701758 | 3/1931 | France | 92/169 |
| 2199811 | 12/1974 | France . | |

*Primary Examiner*—Deborah L. Kyle
*Assistant Examiner*—Richard L. Klein
*Attorney, Agent, or Firm*—Thomas R. Shaffer

[57] ABSTRACT

A cylinder block for a multi-cylinder hydraulic or hydrostatic piston device is provided having a control layer comprising a sintered friction metal layer sintered onto the cylinder block under the simultaneous action of pressure and heat. The end surface of the cylinder block is first provided with an electrodeposited metal layer. The electrodeposited layer has a crystal lattice constant compatible with the sintered layer and the material of the cylinder block. The cylinder block is preferably made from steel or aluminum and the electrodeposited layer is preferably copper or nickel. After the friction metal layer, preferably bronze, is sintered onto the electrodeposited layer, the cylinder block is treated to improve the strength and wear characteristics of the cylinder block without injuring the sliding friction characteristics of the sintered friction metal layer. In the case of steel, the preferred treating process is gas nitriding, and in the case of aluminum or an aluminum alloy, the preferred treating process is anodizing.

8 Claims, 2 Drawing Sheets

MULTI-CYLINDER HYDRAULIC PISTON DEVICE, A CYLINDER THEREFOR, AND ITS METHOD OF MAKING

This application is a continuation of my copending application Ser. No. 294,514, filed Aug. 20, 1981 which was in turn a continuation of my then copending application Ser. No. 022,839 filed Mar. 22, 1979, now abandoned.

BACKGROUND OF THE INVENTION

1. Field of the Invention

The present invention relates to a cylinder block for a hydraulic or hydrostatic piston device, but only the term hydraulic will be used hereinafter for convenience. More particularly, this invention relates to a hydraulic axial piston device having a bronze control surface.

2. Description of Prior Art

One type of hydraulic axial piston device known in the prior art has a steel cylinder block and a control layer formed by casting a bronze layer onto the end surface of the cylinder block (also called a cylinder drum). The bronze layer provides the sliding friction characteristics at the surface of the control layer adjacent to the valve mechanism. Also, each cylinder bore has a bronze or brass bearing bushing for sliding reciprocating movement of the pistons. The cylinder bore in such a cylinder block has, therefore, a greater diameter than the pistons by virtue of the thickness of the brass bushings. If those brass bushings could be eliminated and the cylinder block provided with a piston mounted for reciprocation directly against the inner walls of the cylinder bore, the pistons and thus the power stroke volume would be greater. Alternatively, a stronger and more durable cylinder block can be created if the brass bushings could be eliminated and the thickness of the cylinder block between the cylinders and between the cylinders and the outer wall of the cylinder block could be increased. Also, elimination of the brass bushings in the cylinder block would reduce any tendency of pistons sticking within the brass bushings because of the different rates of heat expansion between material of the piston and the brass bushings and the tendency of the inner diameter of the bushing to be reduced relative to the piston.

The well known practice of casting a bronze layer for the control surface of a cylinder block for a hydraulic axial piston device is disclosed in West German patent application No. 1,963,769. This reference also discloses that the cylinder block can be made from steel or nodular cast iron containing graphite in small spheres and that the inner walls of the cylinder bores can be hardened by liquid nitriding in order to slidably receive hardened steel pistons. However, the requirements for the process of casting the bronze control layer limits the choice of material for the cylinder block. Only a low alloyed steel or nodular cast iron can be utilized which further limits from a practical standpoint the choice of any additional heat treatment to liquid nitriding. Thus, the process parameters of this reference prevent the selection of a material which would lead to a more durable cylinder block.

Sintering a friction metal control layer onto the end surface of a steel cylinder block with the simultaneous action of heat and pressure is disclosed in West German patent application No. 24 31 254. Bronze bushings within each cylinder bore were utilized in this reference. It was not appreciated in this reference that gas nitriding the steel cylinder block would eliminate the need for the bronze bushings without affecting the properties of the sintered bronze layer. This reference includes the use of an intermediate electrodeposited copper layer between the cylinder block and the sintered layer.

Axial position devices with piston rods lying directly against the cylinder wall are disclosed in French patent application No. 73.29921. The drive flange rotates with the cylinder block. The piston rods transmit rotary motion by direct contact with the cylinder walls; the contact force is considerable, especially during changes of angular speed. At the same time, the piston rod slides on the cylinder wall in the direction of the piston movement and simultaneously rotates with sliding contact in the circumferential direction of the cylinder wall. Because of these stresses on the cylinder wall, it has been difficult to produce a cylinder block both strong enough to sufficiently resist these stresses and yet provide the desired frictional characteristics.

Copies of the foregoing references were appended to the original application papers.

SUMMARY OF THE INVENTION

A cylinder block for a multi-layer hydraulic or hydrostatic piston device is provided having a control layer comprising a sintered friction metal layer sintered onto the cylinder block under the simultaneous action of pressure and heat. The end surface of the cylinder block is first provided with an electrodeposited metal layer. The electrodeposited layer has a crystal lattice constant compatible with the sintered layer and the material of the cylinder block. The cylinder block is preferably made from steel or aluminun and the electrodeposited layer is preferably copper or nickel. After the friction metal layer, preferably bronze, is sintered onto the electrodeposited layer, the cylinder bock is treated to improve the strength and wear characteristics of the cylinder block without injuring the sliding fricton characteristics of the sintered fricton metal layer. In the case of steel, the preferred treating process is gas nitriding, and in the case of aluminum or an aluminum alloy, the preferred treating process is anodizing.

The present invention permits the use of a greater number of materials for the cylinder block compared to the prior art because of the greater independence between the material of the cylinder block and the process of applying the control layer. The use of highly alloyed and improved materials is more difficult when the control layer is cast on the cylinder block as in the prior art. In such a process, bronze must be cast onto certain types of steel. However, in subsequent processing, the bronze layer must not contact the liquid nitriding bath because the bath then becomes damaged. In contrast, the process of applying, and the structure of, the control layer in the present invention are such as to allow a greater selection of materials for the cylinder block. For example, a steel cylinder drum made in accordance with the present invention may be subjected to a heat treatment, such as a thermal chemical diffusion process, preferably gas nitriding, wtih an increase of hardness up to about 1000 HV (Vickers hardness) and a hardening depth of about 0.4 mm or greater. Greater flexibility in selecting the materials of the piston and cylinder bore bearing surface is also achieved by the present inventon. A bronze piston may reciprocate in a steel bore, for example. It is also possible to use a piston and cylinder bore bearing surface of hard materials, for exmaple, a hardened steel piston reciprocating within a gas nitrided cylinder bore.

The present invention also permits the use of light metals for the cylinder block, such as aluminum or aluminum alloys. After the intermediate electrodeposited layer and the outer control layer are applied, the cylinder block is anodized (that is, electrically oxidized by any one of a number of well known procedures collectively known as anodizing). In this manner, the pistons can reciprocate directly on the anodized inner surfaces of the cylinder bores.

BRIEF DESCRIPTION OF THE DRAWINGS

The above and other features of the present invention will become apparent from the following descriptions together with the accompanying drawings in which.

DESCRIPTION OF EMBODIMENT

Figure 1:
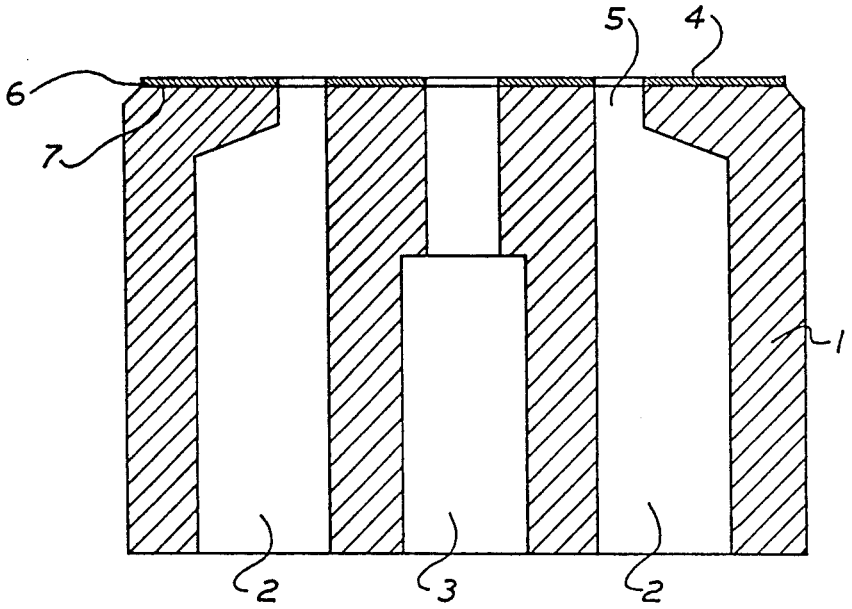
FIG. 1 shows a vertical section of a cylinder block made in accordance with the present invention taken along the axes of two cylinder bores and the cylinder block.

The cylinder block of the present invention can be prepared in the following manner. The cylinder block is machined and finished to the desired dimensions. The cylinder block may be of any suitable material such as steel, aluminum or an aluminum alloy. An end surface of the cylinder block is then electrodeposited with a material of a suitable crystal lattice having a lattice constant compatible with and adatable to the material of the cylinder block. Next, a friction metal layer, preferably bronze, is sintered onto the intermediate electrodeposited layer by simultaneously heating the friction metal material to a sintering temperature and applying pressure. In a preferred practice, the cylinder block is prefinished without any cylinder bores; then the intermediate electrodeposited layer, for example, copper is applied; the friction metal layer, preferably brass, is sintered onto the intermediate electrodeposited layer. Then the cylinder block is finally finished, including the cylinder bores, and treated, as by gas nitriding, to provide a treated surface layer having the desired improved wear characteristics.

The material of the intermediate electrodeposited layer is also selected so that it has a lattice constant compatible with and adaptable to the sintered layer. The distance of the atoms from each other in the crystal structure of steel is much different than that of bronze. This difference in crystal lattice cannot be satisfactorily bridged through the bonding forces produced by diffusion during sintering. However, in the case of an electrodeposited intermediate layer, a transition zone is provided by the intermediate layer for the different crystal lattices. Nickel and copper, especially the latter, are preferred for the intermediate electrodeposited layer.

The details of the sintering process need not be disclosed herein since they are known to one skilled in the art as exemplified by the disclosure of West German patent application No. 24 31 254.

After the control surface is sintered as previously described, the cylinder block is treated to improve the strength and wear characteristics without adversely affecting the sliding friction characteristics of the control surface. For example, in the case of steel, a conventional low temperature gas nitriding process can be utilized to harden the steel cylinder block without impairing the control layer. Temperatures for the gas nitriding process can be from about 500° C. to about 580° C., preferably from about 510° C. to about 520° C. In case of an aluminum or aluminum alloy cylinder block, the cylinder block can be anodized in a known manner without affecting the control layer.

If desirable, the sintered layer can be protected from the subsequent processing (e.g., gas nitriding) by an insulating or protective layer. If no such protective or insulating layer is used, the outer surface of the bronze layer might be effected by the subsequent processing, especially gas nitriding; in that case, the altered surface layer should preferably be removed by a finishing process.

As noted above, anodizing the inner surfaces of the cylinder bores in accordance with the present invention prermits the pistons to move in direct contact therewith. However, it is also possible to increase the strength or improve the sliding friction properties of the cylinder block by inserting high strength bushings in the cylinder bores, such as gas nitrided steel, steel coated with an inner layer of friction metal or high strength bronze. Additionally, light metal cylinder blocks in accordance with the present invention may be strengthened by providing on its outer peripheral surface a jacket, preferably of steel, for at least part of the length of the cylinder block adjacent to the control surface.

FIG. 1 illustrates one example of a cylinder block in accordance with the present invention. The cylinder block 1 can be made of any suitable material such as steel or aluminum. A plurality of cylinder bores 2 are equally distributed about the periphery of the cylinder block. The cylinder bores 2 are arranged within the cylinder block so that the axes of the bores intersect a common circle. Preferably, an odd number of cylinder bores 2 is provided. (The section of FIG. 1 was taken so that the section passes through the axes of two cylinder bores 2 and the axis of the cylinder block.) A central bore 3 coaxial with the axis of the cylinder block is provided to receive a shaft. Each cylinder bore 2 is provided with a port 5 which opens into the end surface 7 of the cylinder block 1. The cylinder block 1 is provided with a control layer 4 using any one of a number of materials known for their sliding friction properties for relative rotary movement of a conventional valve mechanism on the surface of control layer 4.

An electrodeposited metal layer 6 on the end surface 7 of the cylinder block 1 has a crystal lattice constant compatible with and adaptable to the material of the control layer 4 and the material of the cylinder block 1. The intermediate electrodeposited layer 6 is preferably nickel or copper, especially the latter. The control layer 4 can be any suitable material meeating the sliding friction characteristics of the control layer for a cylinder block of an axial piston device. A material such as bronze is preferred. The control layer 4 is sintered onto the intermediate electrodeposited layer 6 by the simultaneous action of pressure and heat.

During the sintering process, the intermediate electrodeposited layer at least partly diffuses into the end surface of the cylinder block and into the sintered layer.

Thus, in the finished cylinder block, the original electrodeposited metal layer may no longer be separately discernible.

Figure 2:
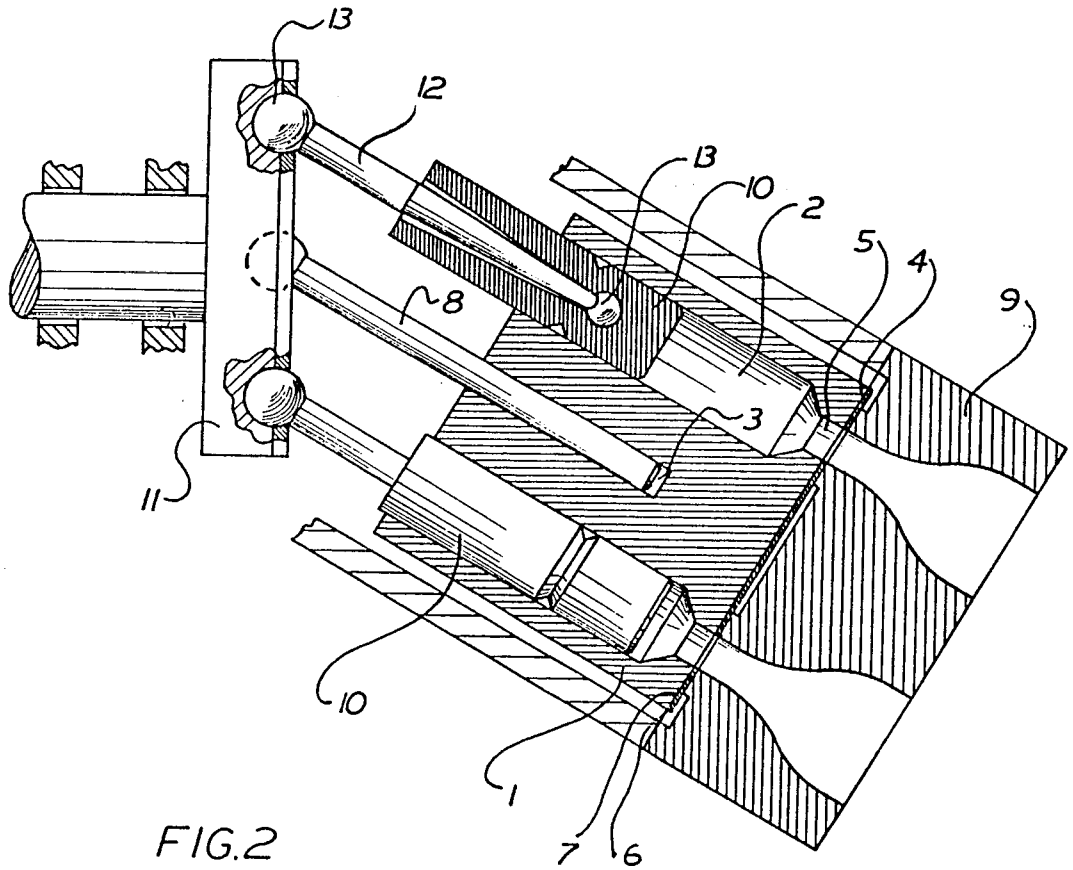
FIG. 2 shows a hydraulic axial piston device utilizing a cylinder block in accordance with the present invention.

A hydraulic axial piston device utilizing a cylinder block of the present invention is illustrated in FIG. 2. A drive-flange or bent-axis device is shown by way of illustration and can be either a pump or motor. Like numbers are used to designate similar portions of the cylinder block in both FIGS. 1 and 2. The cylinder block 1 rotates about shaft 8 relative to a valve mechanism 9. The control layer 4 of the cylinder block 1 rotates in sliding contact relative to the valve mechanism 9. Pistons 10 are mounted for reciprocation within the cylinder bores 2. The pistons 10 are connected to a drive-flange 11 by connecting rods 12. Each piston connecting rod 12 has two ball-and-socket joints 13 for connection with drive flange 11 and the pistons 10.

Figure 3:
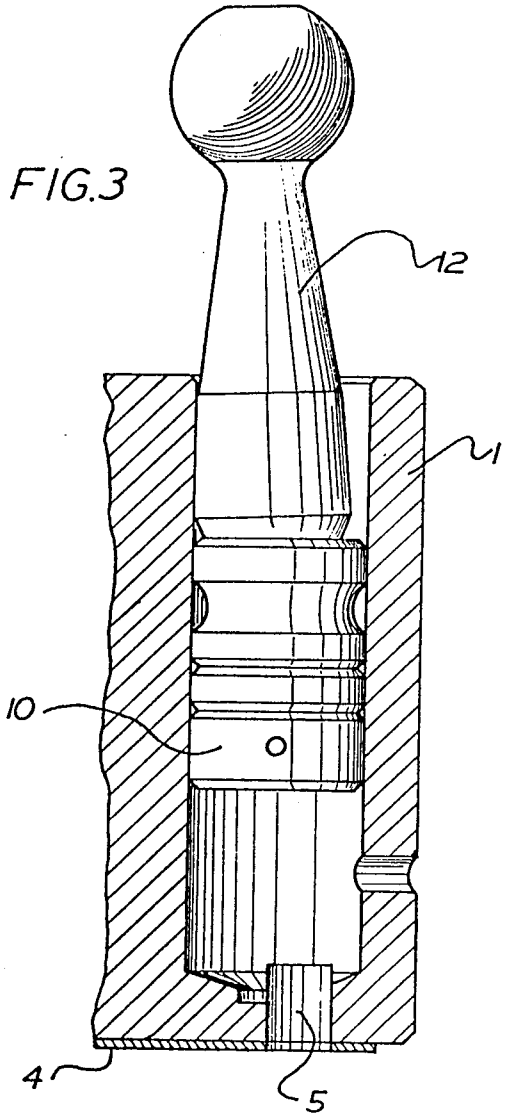
FIG. 3 shows a section of a portion of a hydraulic axial piston device where the piston rod contacts the cylinder bore.

The present invention can be advantageously used in hydraulic axial piston devices wherein rotary motion is transmitted to a cylinder block by contact between the piston rod and cylinder bore, such as the type of device illustrated in FIG. 3. In this type of drive-flange device using short pistons, each piston rod contacts at least a portion of the inner wall of the corresponding cylinder bore during the piston stroke. Such a structure has the advantage of operating at a greater swash angle or using piston rods of a greater thickness. The improved bearing properties of the cylinder bores in the cylinder block of the present invention, especially for gas nitrided steel or anodized light metals such as aluminum, permits the use of the cylinder block in an axial hydraulic piston device in which the piston is mounted for reciprocation on a piston rod rotating with a drive flange. In such a device using short pistons, the piston rod bears directly against a portion of the inner wall of each cylinder bore in order to transmit rotary motion to the cylinder drum. The piston rods can bear directly against at least a portion of the inner wall of each cylinder bore of cylinder blocks of the present invention, especially in the case of gas nitrided steel or anodized aluminum cylinder blocks. However, it may be desirable to employ cylinder liners or bushings in the cylinder bores of the anodized aluminum cylinder blocks. In that event, the cylinder liners can be of such a size such that both the piston and the piston rod slide against the cylinder liner or bushing. In another form, only the piston slides against the cylinder liner and the piston rod slides against the material of the cylinder block. Alternatively, the piston can slide against the material of the cylinder block while the piston rod slides against a high strength bushing. As noted above, axial piston engines with piston rods directly contacting the cylinder walls are known (see French patent application No. 73.29921).

A cylinder block of a light metal such as aluminum has a lower moment of inertia about the axis of rotation compared to a steel cylinder block of the same dimensions. As a result, the force necessary to accommodate changes in the angular speed of a rotating cylinder block are less for a cylinder block of a light metal such as aluminum compared to a cylinder block of steel.

A cylinder block in which the pistons bear directly against the material of the cylinder block has certain advantages over a cylinder block having cylinder liners or bushings, such as bronze bushings. Assuming equal outer dimensions and thus approximately the same moment of inertia, a piston diameter without liners or bushings can be increased by an amount equal to about double the thickness of the wall thickness of the bushing or liner. Alternatively, a piston of the same diameter could be used while decreasing the diameter of the cylinder bore and the outer diameter of the cylinder block which in turn reduces the moment of inertia compared to a cylinder block with a liner or bushing. The cylinder block of the present invention is particularly advantageous when a cylinder block of gas nitrided steel in accordance wtih the present invention is used for a drive-flange axial piston device wherein the piston rods bear directly against a portion of each cylinder bore for the purposes of transmitting rotary motion to the cylinder block. This is true whether or not a cylinder bore passes through to the end of the cylinder or is offset in part to support the piston rods.

What is claimed is:

1. A process for producing a cylinder block for a multi-cylinder hydraulic axial piston device comprising the steps of forming a generally cylindrical steel cylinder block having a plurality of cylinder bores in said cylinder block each having an axis parallel to the axis of the cylinder block and opening into an end surface of the cylinder block transverse to the axis of the cylinder block and adapted to rotate in frictional contact with a valving surface, finishing the cylinder block to its final shape, electroplating a metal layer upon said end surface of said cylinder block and sintering an anti-friction metal layer onto said electrodeposited layer by simultaneously heating the metal material to a sintering temperature and applying pressure to said anti-friction metal material while sintering, said electrodepositd layer having a crystal lattice constant compatible with said sintered layer and the material of said cylinder block, and chemically treating said cylinder block by gas nitriding at a low temperature such that the tempering properties and the steel are not effected to form an in situ integral surface layer improving the wear characteristics of said cylinder block without reducing the sliding friction properties of said sintered layer.

2. A process for producing a cylinder block for a multi-cylinder hydraulic axial piston device comprising the steps of forming a generally cylindrical aluminum cylinder block having a plurality of cylinder bores in said cylinder block each having an axis parallel to the axis of the cylinder block and opening into an end surface of the cylinder block transverse to the axis of the cylinder block and adapted to rotate in frictional contact with a valving surface, finishing the cylindrical block to its final shape, electroplating a metal layer upon said end surface of said cylinder block and sintering an anti-friction metal layer onto said electrodeposited layer by simultaneously heating the metal material to a sintering temperature and applying pressure to said anti-friction metal material while sintering, said electrodepositd layer having a crystal lattice constant compatible with said sintered layer and the material of said cylinder block, and chemically treating said cylinder block by anodizing at a low temperature such that the tempering properties and the aluminum are not effected to form an in situ integral surface layer improving the wear characteristics of said cylindrical block without reducing the sliding friction properties of said sintered layer.

3. A process as claimed in claim 1 wherein a material selected from the group consisting of copper or nickel is electrodeposited onto said end surface of said cylinder block.

4. A process as claimed in claim 1 wherein said sintered friction metal is bronze.

5. A cylinder block for a multi-cylinder hydraulic axial piston device formed by the process of claim 1.

6. A process as claimed in claim 2 wherein a material selected from the group consisting of copper or nickel is electrodeposited onto said end surface of said cylinder block.

7. A process as claimed in claim 2 wherein said sintered friction metal is bronze.

8. A cylinder block for a multi-cylinder hydraulic axial piston device formed by the process of claim 2.

* * * * *

UNITED STATES PATENT AND TRADEMARK OFFICE

CERTIFICATE OF CORRECTION

PATENT NO. : 4,799,419

DATED : January 24, 1989

INVENTOR(S) : Bernd Krause

It is certified that error appears in the above-identified patent and that said Letters Patent is hereby corrected as shown below:

Column 2, line 8, change "position" to --piston--.

Column 2, line 26, change "multi-layer" to --multi-cylinder--.

Column 2, line 38, change "bock" to --block--.

Column 4, line 24, change "prermits" to --permits--.

Column 4, line 60, change "meeating" to --meeting--.

Column 6, line 49, change "cylindrical" to --cylinder--.

Column 6, line 62, change "cylindrical" to --cylinder--.

Signed and Sealed this

Twenty-first Day of November, 1989

*Attest:*

JEFFREY M. SAMUELS

*Attesting Officer* *Acting Commissioner of Patents and Trademarks*